US007031225B2

(12) United States Patent
McDonald

(10) Patent No.: US 7,031,225 B2
(45) Date of Patent: Apr. 18, 2006

(54) WIRELESS MULTIPLE NON-SYNCHRONIZED ATHLETIC EVENT TIME KEEPING AND COMMUNICATION SYSTEM

(76) Inventor: William J. McDonald, 77 Park View Dr., Eldridge, IA (US) 52748

( * ) Notice: Subject to any disclaimer, the term of this patent is extended or adjusted under 35 U.S.C. 154(b) by 450 days.

(21) Appl. No.: 10/393,730

(22) Filed: Mar. 21, 2003

(65) Prior Publication Data

US 2004/0184354 A1 Sep. 23, 2004

(51) Int. Cl.

| | |
|---|---|
| ***G04B 47/00*** | (2006.01) |
| ***G04C 11/02*** | (2006.01) |
| ***G08B 23/00*** | (2006.01) |
| ***H04B 1/34*** | (2006.01) |

(52) U.S. Cl. ..... 368/10; 368/47; 368/109; 340/323 R; 340/539.11; 455/100; 463/39

(58) Field of Classification Search ..... 368/3, 368/10, 47, 107–109; 340/323 R, 539.1, 340/539.11, 309.16; 455/39, 66.1, 70, 100; 463/36, 39, 40

See application file for complete search history.

(56) References Cited

U.S. PATENT DOCUMENTS 3,969,886 A * 7/1976 Yoda ..... 368/73

(Continued)

OTHER PUBLICATIONS

"Application Note AN-00125 Considerations for Operation within 260-470 band," published by Linx Technologies, Medford, OR USA, pp. 1-4, Copyright 1997.

(Continued)

*Primary Examiner*—Vit W. Miska
(74) *Attorney, Agent, or Firm*—Jay R. Hamilton

(57) ABSTRACT

The described invention combines wireless transmission and reception technologies with athletic event timers to remove and reduce human and environmental factors that interfere with the athletic event timekeeping process for improvement of the process. The system controls and communicates the timing of a single athletic event between the timekeeping mechanism and the referee using at least one timing communicator with a transmitter and a channel selector. The transmitter is adapted to transmit a wireless electromagnetic radiation signal from outside the field of play to the field of play to a mobile field communicator having a receiver and channel selector also responsive to the channel selector. The mobile field communicator is adapted to be carried by the umpire or referee on the field of play and to receive the wireless signal from outside the field of play and emit an actuation signal in response thereto. The mobile field communicator and timing communicator channel selectors can be synchronized to produce the assignment of a unique address to allow the mobile field communicator and timing communicator to operate independently and securely without interference from other similar mobile field communicator and timing communicator devices in use within range of the system.

30 Claims, 5 Drawing Sheets

U.S. PATENT DOCUMENTS

| | | | | |
|---|---|---|---|---|
| 4,526,479 | A | 7/1985 | Harris | |
| 4,879,553 | A * | 11/1989 | Righi | 340/932.2 |
| 5,027,102 | A * | 6/1991 | Sweeny | 340/323 R |
| 5,293,354 | A | 3/1994 | Costable | |
| 6,072,751 | A * | 6/2000 | Kirson et al. | 368/2 |
| 6,181,236 | B1 * | 1/2001 | Schneider, Jr. | 340/326 |
| 6,369,697 | B1 | 4/2002 | Poole | |
| 6,424,598 | B1 | 7/2002 | Shultz | |
| 6,603,711 | B1 * | 8/2003 | Calace | 368/109 |
| 6,725,107 | B1 | 4/2004 | MacPherson | |
| 6,816,442 | B1 * | 11/2004 | Heiman et al. | 368/109 |

OTHER PUBLICATIONS

"Application Note AN-00140 The FCC Road: Part 15 from Concept to Approval," published by Linx Technologies, Medford, OR USA, pp. 1-2, Copyright 1997.

"KH Series Transmitter/Encoder Data Guide," published by Linx Technologies, Medford, OR USA, pp. 1-20, Copyright 2004.

"KH Series Reciever/Decoder Data Guide," published by Linx Technologies, Medford, OR USA, pp. 1-20, Copyright 2004.

* cited by examiner

WIRELESS MULTIPLE NON-SYNCHRONIZED ATHLETIC EVENT TIME KEEPING AND COMMUNICATION SYSTEM

BACKGROUND OF THE INVENTION

1. Field of the Invention

The present invention relates generally to systems for time management in sporting events and more particularly, but not by way of limitation, to a system allowing for wireless communication of event timing to officiating personnel.

2. Background of the Invention

The sports of basketball, football, hockey and wrestling all share one important factor—time. The importance of time keeping and an indisputable decision on when the clock has stopped or should be stopped in fast paced athletic events has existed as long as the sports themselves have been played with formal rules and timers. Most athletic events requiring timekeeping segregate the duties of timekeeping and officiating the game or match. Different people or groups of people carry out the important functions of officiating and timekeeping. To meet this need for exact timing, the state of the art has either connected highly precise clocks to buzzers, horns and flashing lights or required human action in the time starting or stopping process. See U.S. Pat. No. 6,369,697 B1 ('697) which teaches using a wireless system requiring simultaneous operation of a plurality of clocks through multiple mobile transmitters to an off-field single receiver.

However, no system has emerged to directly connect the two main participants in the timekeeping process—the official or referee down on the field, mat or floor and the official timekeeper monitoring or managing the athletic event time. Not having a device to assist these two parties in communicating introduces the potential for error in the process and may ultimately affect the outcome of the match or game. For example, at the end of a hypothetical wrestling match, the score could be tied. To break the tie, there could be a flurry of activity between the opponents in a last second attempt to score points and break the tie. The referee at the exact moment time is to end may have to make a split-second decision as to whether points have been scored before times runs out or if no points are to be scored if time has already expired. The current technology involves having someone with a rolled-up towel whack the referee with the towel when the timekeeper signals to the towel holder that time has expired. The potential error introduced in this situation is compounded if the wrestling match is during a tournament where multiple matches may be taking place potentially distracting the timekeepers, towel holders and or individual match referees. Many times major athletic tournaments require multiple games or matches to be played on different fields or areas of the stadium at the same time. The confluence of multiple on-going matches each requiring separate referees and timekeepers only serves to amplify the interference encountered by the referees and timekeepers in attempting to communicate and carry-out their respective duties.

Other factors potentially compounding the communication problems between game or match officials and timekeepers are the size of the area of play, the pace of the sport played and the inherent mobility required of the referee. For example, the quality of timekeeping for a high school football game could be affected by all of these factors. Football fields are 100 yards long and 50 yards wide.

Timekeepers are usually located in the stands another 20–30 yards from the field while referees are located on the field. To communicate at the start of the game, end of the quarters, half-time and the end of the game, the timekeeper signals the referee using horns, buzzers or gunshots. The referee communicates with the timekeeper using a whistle to signal the timekeeper to stop the clock. The timekeeper restarts the game clock thus counting down time when the football goes "into play" i.e. the offensive center has moved the ball or the kicker has kicked the ball. Environmental conditions can interfere with this communication process and affect the quality of timekeeping. During a single play in a football game, one referee may have to move 50–100 yards to maintain line of sight with the football and signal the timekeeper that the clock should be stopped if play stops because the ball is down or out of bounds; or a touchdown or safety has been scored. Many times the referee has to engage in this rapid movement with the whistle in his mouth obstructing his airway and producing a potential hazard. Because the communication process is unprotected and interference from the general environmental conditions (i.e. fan noise, wind noise, darkness, snowfall, etc.) accompanying the event can interfere with the communication process, the quality of the timekeeping could suffer again affecting the ultimate outcome. The invention described by U.S. Pat. No. 5,293,354 ('354) applies advanced technology to this situation but inherently fails to solve the main problem associated with the athletic event—background inference. This patent describes an invention that improves communication between the time mechanism and the referees by receiving the sound produced by the official's signal (i.e. whistle) to then effectuate the automatic starting and stopping of the clock or timing mechanism. The patent describes a complex system combining transmitters, receivers, mixers and filters necessary to handle the background noise and inference found at the athletic event to allow the communication between the referee and the timing mechanism. The system defines a complex system for the complex problem caused by background noise which can be especially difficult to filter or control when multiple non-synchronized wrestling matches are taking place inside a gymnasium or other indoor venue amplifying and distorting the background noise and inference.

The '354 patent does not address the unique problem of multiple non-synchronized athletic events taking place in close proximity to each other such as found in wrestling tournaments involving multiple participants. Additionally, the importance of having the timekeeper control the timing of the athletic event is devalued and considered only necessary if the described automated remote control fails.

It is an object of this invention to optimize the performance of the referee by allowing the referee to focus solely on the action occurring on the field of play and delegate official timing duties to other officials. The failure of the designs described by the '354 and '697 patents is underscored by their limited use in the market place and inability to enter the market in large numbers.

Another factor affecting the quality of the officiating is the referee's auditory capacity. It is well known that age and or continuous exposure to loud noise can damage a person's hearing and result in a loss of auditory reception. Referees can be forced to prematurely retire, resulting in a great loss of officiating experience, due to a reduced ability to hear the timekeeper's signals. It is clear that an advancement in the communication between those with timekeeping duties and those with officiating duties is needed.

SUMMARY OF THE INVENTION

The proposed invention described solves these problems and has the following advantages over the current state of the art by protecting the communication process, reducing and or eliminating background interference and decreasing referee or umpire response times while increasing user comfort, the quality of officiating, referee mobility and engagement in the participant's field, floor or match activities.

The described invention combines wireless transmission and reception technologies common in the art with athletic event timers in a novel way to solve the problems described in the background. The described invention seeks to remove and reduce the human and environmental factors that interfere with the athletic event timekeeping process for improvement of the process.

It is an object of this invention to provide a method and apparatus for athletic events, requiring time to be kept, which permits the timekeeper to provide almost instant notice to on-field or on court or mat side referee(s) or umpire(s) that match or game time has expired.

It is another object of this invention to provide a method and apparatus for athletic events, requiring time to be kept, which permit's the timekeeper to warn on-field or court side referee(s) or umpire(s) that time is about to expire.

It is another object of this invention to provide a method and apparatus allowing for independent notice to the referee(s) or umpire(s) involved in multiple non-synchronized games or matches located in close physical proximity to each other that time is about to expire or has expired.

An another object of the proposed invention is to provide this increased quality and communication in a lower cost, lower weight and simpler design that is easily operated by referees and officials.

According to the present invention there is provided a timing system for at least one sports game or other timed athletic event, which system compromises:

at least one timing communicator device having a switch means and a transmitter means responsive to the switch means and transmitter means and adapted to transmit a coded wireless electromagnetic radiation signal from outside the field of play to the field of play;

at least one mobile field communicator carried by the umpire or referee on the field of play to receive said signal from outside the field of play and emit an actuation signal in response thereto;

said mobile field communicator and timing communicator having a unique addressing means that allows independent operation without interference from other mobile field communicator and timing communicator devices in close proximity;

a timer connected to the timing communicator means and adapted to start and stop timing in response to an actuation signal from outside the field of play, said actuation signal either manually controlled by an athletic event timekeeper who is not located on the field of play but in close proximity to it or automatically controlled by the connected timer system.

The system as built and put through field trials has been a stand-alone system encompassing providing both a timer and a communication system. Many users have found it preferable during initial trials for the timing communicator device to remain portable and not connected to an existing timing and scoring system. It is envisioned, however, that the system can also function as either an add-on module to most existing permanently affixed analog or digital timing systems. The transmission means of the timing communicator device may also be linked to an actuation control means allowing a connected timer system to control actuation of the signal transmitted to the field communicator at the required times during the game or match. This functionality allows the timekeeper to automatically actuate the signal transmission by simply stopping or starting the timekeeping system. It is envisioned that this may best be accomplished by full integration within the circuitry of newly designed or manufactured timekeeping systems for future permanent installation.

Preferably the transmitted signal is in the infrared or radio range. The best mode developed and implemented by the inventor uses a radio frequency (RF) transmission and reception system functioning in the 418 megahertz (MHz) frequency. This band was chosen because it is a very clean (low interference) frequency in the United States (US) and it is also appropriate for operation in the US and United Kingdom (UK). The 260–470 MHz band has been chosen because it is ideal for instances where control, command or status signals need to be sent periodically over short ranges for either analog or digital transmissions.

This choice of frequency also allows for longer transmission distances with less power. The free space propagation of frequencies in this range is significantly better than at higher frequencies, such as 900 or 2.4 GHz. Therefore, lower output power is needed to attain any particular distance. Since less output power is needed, transmitter power consumption is significantly reduced. This band was also chosen for its cost effective attributes. The components necessary to broadcast in the 260–470 MHz band are significantly lower in cost than those designed for operation at higher frequencies thus optimizing product cost with performance. Finally, the 260–470 MHz band rate was chosen because it allows for easy export to other countries. Countries in addition to the US and UK have also allocated this frequency band for uses such as that described herein therefore insuring international compatibility.

If the timekeeper starts or stops the clock, the transmission means located in the timing communicator sends a signal to the small mobile field communicator worn by the referee on the field (hereinafter field will also be understood to mean floor, mat or any other term used by the particular sport to describe the area or location of play). The small mobile field communicator worn by the referee converts this signal into a tone, vibration or flashing light for transmission and communication with the referee.

In the preferred embodiment of the invention the field communicator's receipt of a signal activates both a flashing light and vibration mechanism. In the preferred embodiment pre-time expiration warning signals (i.e. at ten (10) and five (5) seconds before time expires) are sent to the field communicator worn by the referee. Each warning signal is unique and corresponds to an ascending level or intensity of vibration. The final signal corresponding to the expiration of time sends a signal that has a higher intensity than the previous signals to emphasize that time has expired. Additionally a light on the receiver flashes. This flashing light serves two purposes. It provides redundancy to the vibration mechanism and also provides the timekeeper with visual confirmation that the wireless signal was sent and received by the referee's field communicator. In this embodiment if the referee stops or starts the clock, the timekeeper must enter this information independently of the system described herein. Electronic signal communication and the timekeeping mechanism in this embodiment are controlled only by the timekeeping official.

Importantly, the system and method described herein fails if it is not secure or if the use of other units in close proximity interferes with its operation. The system is not secure if outside influences such as car alarms or garage door openers affect the signals communicated between each set of officials. The transmission system signal is encoded to avoid communication failure based upon interference from alternative transmission means.

Because this invention is meant to also meet the demands of multiple on-going games or matches played in a common arena or on a common field, potentially in close proximity, it is of the utmost importance that each pair of officials (meaning the referee or referees controlling one game or match and the timekeepers dedicated to supporting that game or match) have the ability to synchronize their communications systems. The invention described herein accomplishes this through the use of a channel selector means. The channel selector means in the preferred embodiment assigns a finite set of unique addresses to each channel. Each set of timing and field communicators [one (1) timing communicator and one (1) field communicator] assigned to a match or game must be set to the same channel to avoid the possibility of interference from another set of timing and field communicators being used in close proximity. This mode of operation is necessary to support an event such as a wrestling tournament with multiple non-synchronized matches taking place in a confined space. The system will also operate with a plurality of field communicators set to the same unique channel as the timing communicator allowing multiple field referees to work together without interference from another set of timing and field communicators. Each set of officials can choose a unique communication channel to ensure no conflicts or interference from another set of officials in the proximity of the field of play or within the transmission range of the devices.

The channel selector may also be enabled by assigning a unique frequency range to each channel if alternative transmission means are used.

Another embodiment of this device connects the timing system used by the timekeeper to a two-way transmission reception mechanism. The referee may directly actuate stopping or starting the clock through the mobile field communicator. When play is set to begin, the referee may simultaneously communicate to the players and the timer communicator that the clock has started. The referee's actuation of the mobile field communicator transmits a signal directly to the receiver mechanism in the timing communicator. The receiver mechanism upon receipt of the signal activates the timekeeping mechanism to begin the countdown process. The timekeeper can also use this signal to stop the clock or even override the signal if necessary. The timekeeper retains control over corrections to be made to the event time. In this way the referee continues to control the on field play but is not primarily responsible for the timekeeping function.

According to the present invention as described in this alternative embodiment, there is provided a timing system for at least one sports game or other timed athletic event, which system compromises:

at least one timing communicator device located outside the field of play having a transmitter means, a receiver means and a switch means;

said transmitter and receiver means responsive to the switch means and adapted to transmit or receive a wireless electromagnetic radiation signal between outside the field of play and the field of play;

at least one field communicator that is mobile and has both a transmitter and a receiver means;

said field communicator is carried by the umpire or referee on the field of play, with said transmitter means adapted to send a signal from the field of play to outside the field of play;

said field communicator is enabled to emit an actuation signal in response thereto a transmission from the field of play to outside the field of play;

said timing communicator emitting an actuation signal in response thereto receiving a signal from the field of play;

said field communicator and said timing communicator having a channel means to assign an unique address to said set of timing communicator and field communicator that allows independent operation without interference from other field communicators and timing communicators;

a timer system connected to said timing communicator and adapted to start and stop timing in response to an actuation signal from outside the field of play;

said actuation signal being either manually controlled by an athletic event timekeeper or automatically controlled by the timer system which is not located on the field of play but in close proximity to it.

Another embodiment of the invention allows the field communication device to replace the typical whistle used in athletic events. The field communicator transmission means is adapted to actuate an auditory system within the field communicator to produce a loud audible response for the event participants from the field communicator when a signal is transmitted to the timing communicator.

DETAILED DESCRIPTION OF THE INVENTION

Figure 1:
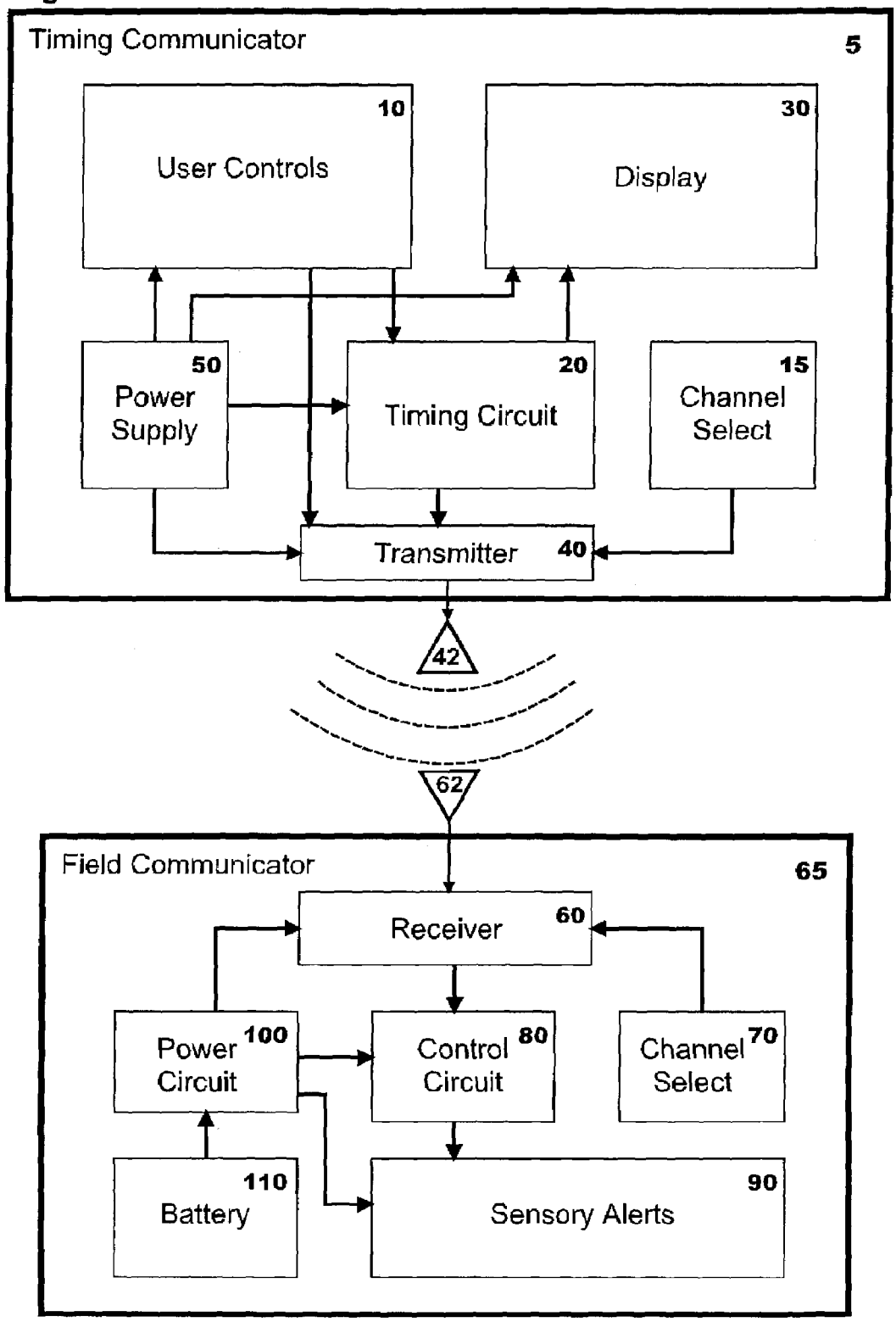
FIG. 1 shows a block diagram of the timing communicator and mobile field communicator unit for the following invention.

Reference is first made to FIG. 1, which is a block diagram of how the preferred embodiment of the present invention works. In a typical match or game when the referee begins play, the timekeeper through the user controls 10 located on the timing communicator 5 first sets the match or game time. The timekeeper then uses the channel selector 15 to choose a channel unique for the playing field, court or mat for which he is responsible. The timekeeper then allows match or game time to begin, upon a signal from the referee and starts the timekeeping function through the user controls 10 actuating the timing circuit 20. The user control 10 is connected to the transmitter 40 and the timing circuit 20. The control unit power supply 50 provides the electrical power necessary for the timing circuit 20, the user controls 10 and the transmitter 40. The signal from transmitter 40 is conveyed through antenna 42. The primary function of the user control 10 is to actuate the timing circuit 20. An auxiliary function available to the user is to engage the transmitter 40 to directly signal the mobile field communicator unit 65 carried or worn by the referee on the field without communicating through the timing circuit 20.

The timing circuit 20 signals both the transmitter 40 and the display mechanism 30. The display mechanism 30 can be lights, a buzzer, or a clock visible to the game participants as well as spectators. The transmitter 40 conveys a coded electromagnetic signal on the chosen channel selected by the timekeeper to the mobile field communicator unit 65 set to receive on that channel upon actuation by the timing circuit 20 or the timekeeper. The signal received through antenna 62 by the mobile field communicator unit's receiver 60 actuates the controls circuit 80. The control circuit 80 is actuated only if the mobile field communicator unit 65 is set to the same channel as the timing communicator unit transmitter 40 using the channel selector 70. The control circuit 80 actuates the sensory alerts 90. The sensory alerts 90 in the preferred embodiment are flashing lights. However, the sensory alerts may include a voice signal, buzzer or vibrating mechanism. A battery 110 provides the necessary power supply for the power circuit 100. The power circuit 100 converts the battery voltage to the voltage necessary for all of the mobile receiver unit 65 components.

Figure 2:
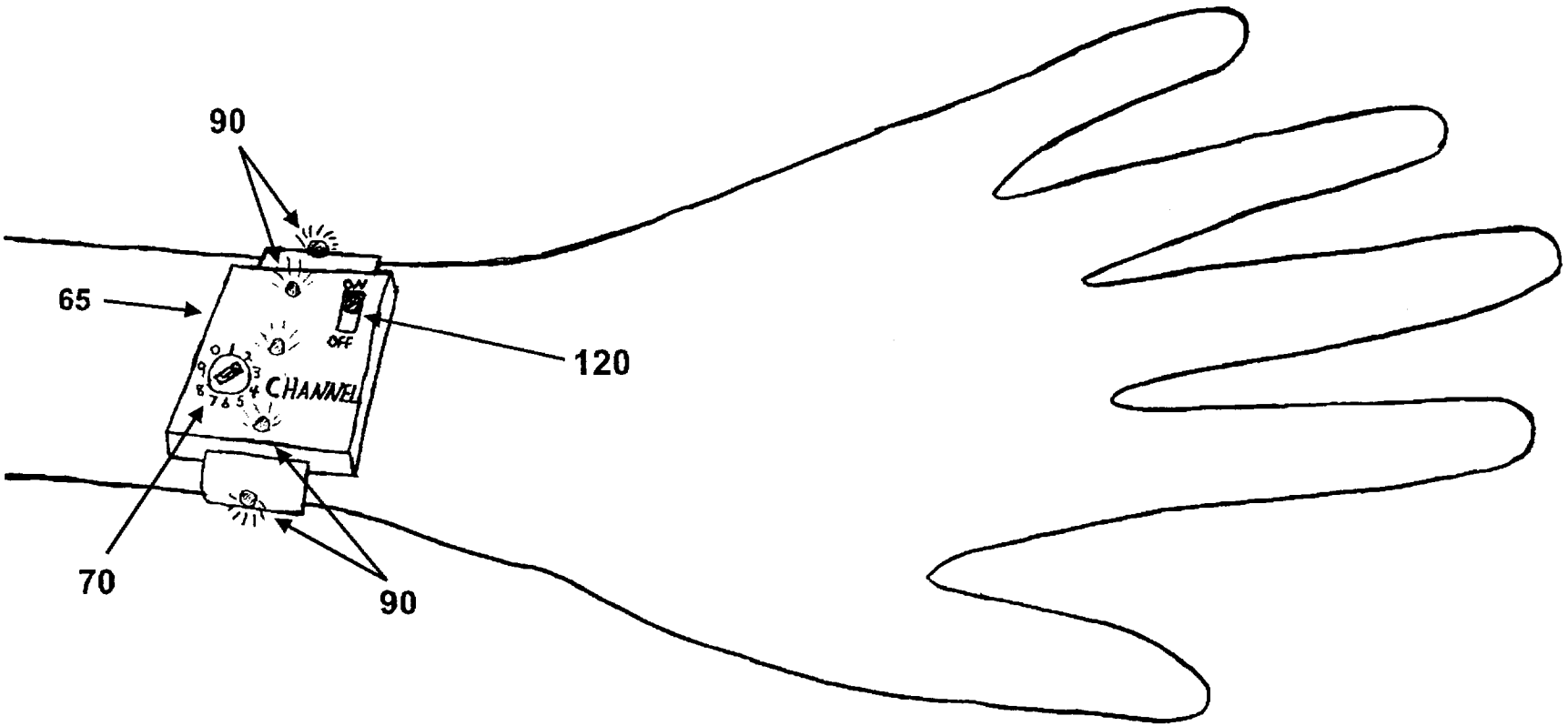
FIG. 2 shows an embodiment of the mobile field communicator unit attached to a user for the following invention.

Reference is next made to FIG. 2 showing an embodiment of the mobile field communicator unit 65 attached to a user. The mobile field communicator unit 65 has a manual on-off switch 120 for power control. It also has a channel selector 70 allowing the user to select a unique channel for the mobile field communicator unit 65. During use, the mobile field communicator unit 65 and the timing communicator unit 5 must use the same channel. The sensory alerts 90 for this embodiment are shown as blinking lights. Vibratory and auditory alerts are also contemplated. The preferred embodiment employs both vibratory and auditory alerts.

Figure 3:
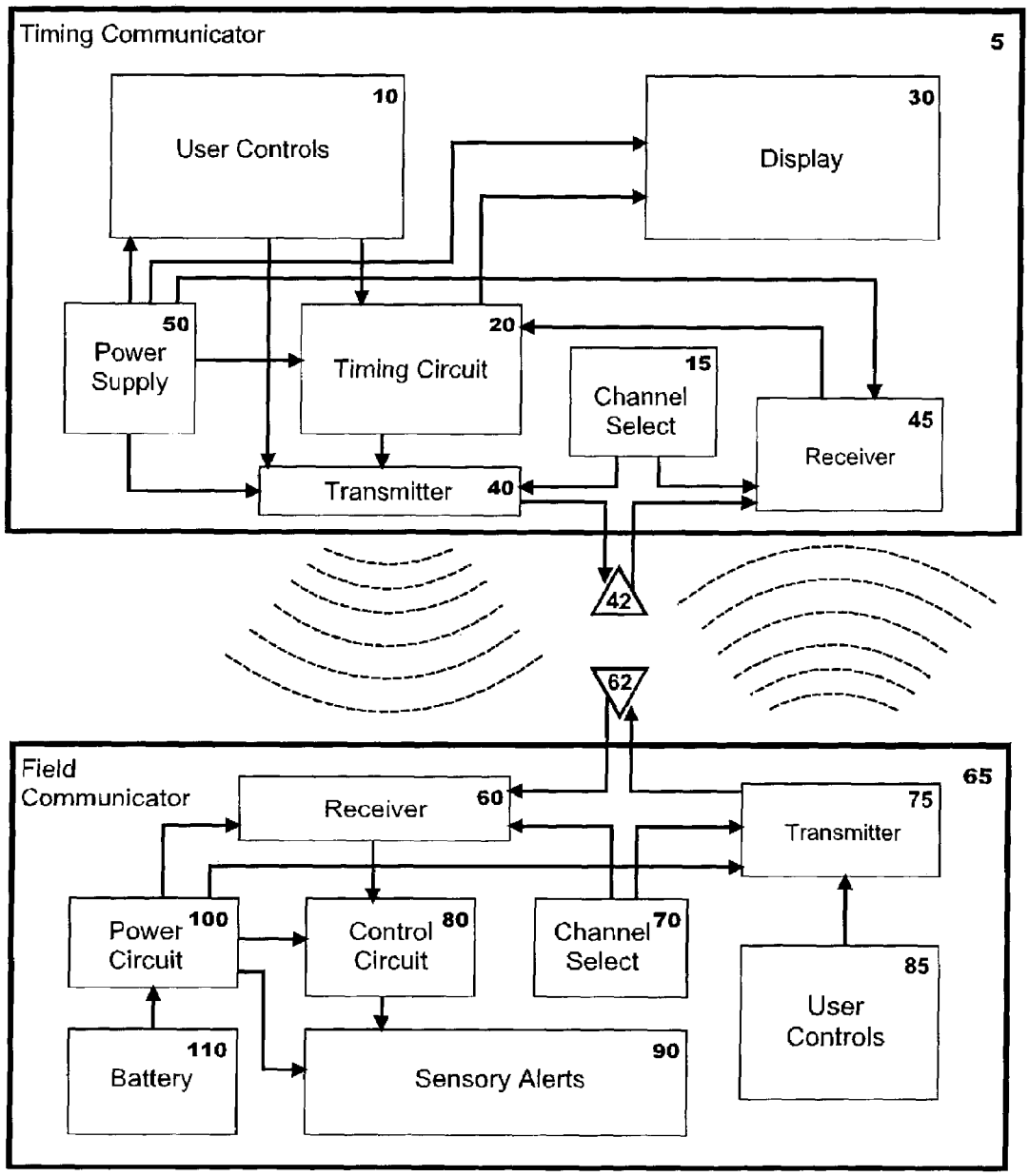
FIG. 3 shows a block diagram of the timing communicator unit and mobile field communicator unit with two-way communication for the following invention.

Reference is next made to FIG. 3 showing the timing communicator unit 5 and mobile field communicator unit 65 that allows for two-way communication. In this embodiment the system allows two-way communication between the timekeeper and the referee. Similar to the one-way communication system described in FIG. 1, the timekeeper through the user controls 10 located on the timing communicator unit 5 first sets the match or game time. The timekeeper then uses the channel selector 15 to choose a channel unique for the playing field, court or mat for which he is responsible. The channel selected using the channel selector 70 on the mobile field communicator unit 65 used by the referee must correspond to the unique channel chosen by the timekeeper using the channel selector 15 of the timing communicator unit 5. Unlike the one-way system described in FIG. 1, the referee may control the beginning of a match or stopping the clock through user controls 85 on the mobile unit communicator 65 thereby sending a wireless signal from his field communicator unit 65 to the transmitter 75 through antenna 62 to the timing communicator unit receiver 45 via antenna 42. Upon receiving the signal, the timing communicator unit receiver 45 transmits a signal to the timing circuit 20 starting or stopping the timekeeping function. The timing circuit upon activation sends a signal to the display 30.

Figure 4:
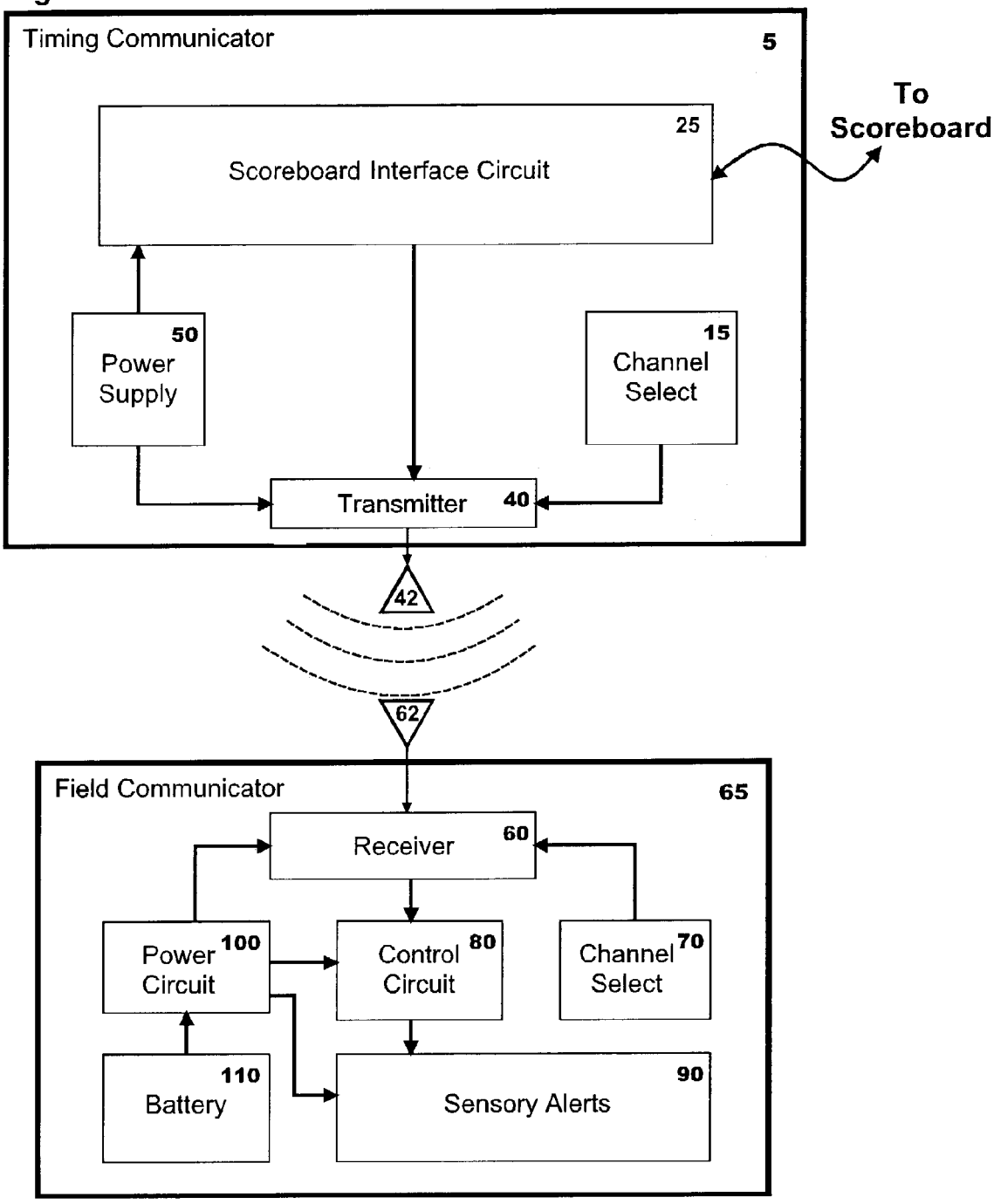
FIG. 4 shows a block diagram of the system as an add-on to an existing timing and scoring system for the following invention.

Reference is next made to FIG. 4 showing a block diagram of the system as an add-on to an existing timing and scoring system. In this embodiment the system can function in either the one-way transmission mode as described in FIG. 1 or the two-way transmission mode as described in FIG. 3. The timing communicator unit 5 is compromised of a transmitter 40, a power supply 50 and a channel selector 15. The scoreboard interface circuit 25 also provides an interface to an external timing device and or an external display device allowing the user's existing hardware to be used with the system herein described. The timing unit user controls 10, timing circuit 20 and display 30 herein can be used to control the outside display system through the scoreboard interface circuit 25. The scoreboard interface circuit 25 can also be modified to allow the outside display system to replace the user controls 10, timing circuit 20 and display 30 to control the transmitter 40 or receiver 45.

The timekeeper and referee still use the channel selector 15 to choose a channel unique for the playing field, court or mat for which they are responsible. The components and functions of the mobile field communicator 65 do not change.

Figure 5:
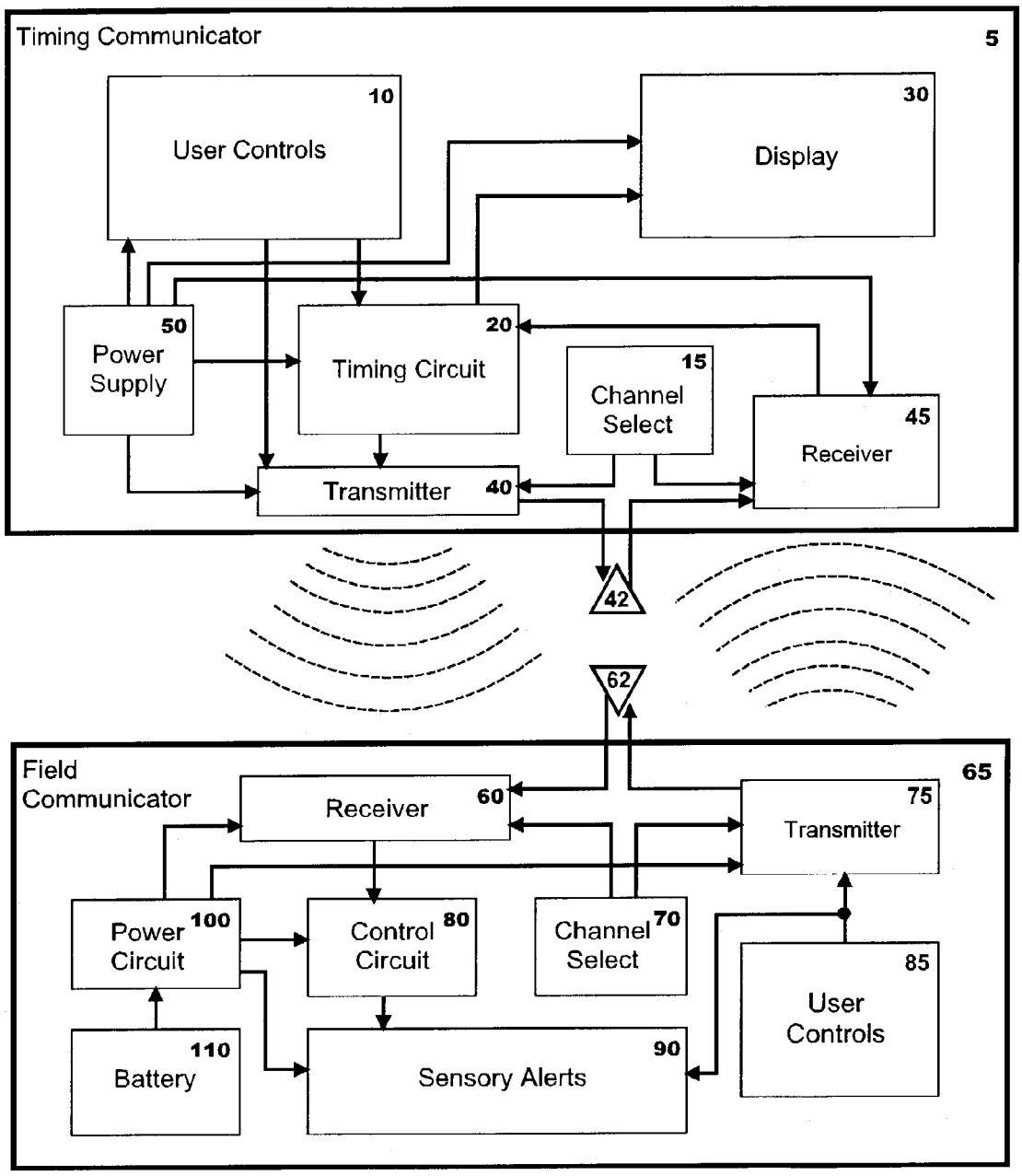
FIG. 5 shows a block diagram of the system incorporating a auditory actuation system within the field communicator for the following invention.

Reference is next made to FIG. 5 showing a block diagram of the system in the two-way transmission mode as described in FIG. 3. Additionally, the sensory alerts 90 include an auditory system. The referee starts or stops the timing circuit 20 through the user controls 85. The signal to the transmitter 75 from the user controls 85 travels in parallel to the sensory alerts 90 which include an auditory system thereby replacing the function of the whistle.

While the present invention has been described with respect to certain preferred embodiments thereof, it is to be understood that numerous variations in the details of the construction, the arrangement and combination of parts, and the type of materials used may be made without departing from the spirit and scope of the invention.

I claim:

1. A system for use in controlling and communicating the timing of a single athletic event between a timekeeping mechanism and a referee, the improvement compromising:

a. at least one timing communicator device having a switch means, a transmitter means and a channel selector, said transmitter means responsive to the switch means and channel selector and said transmitter means adapted to transmit a wireless electromagnetic radiation signal from outside the field of play to the field of play;

b. at least one mobile field communicator also having a receiver means and channel selector, said receiver means responsive to said channel selector;

c. said at least one mobile field communicator adapted to be carried by the umpire or referee on the field of play and to receive said wireless signal from outside the field of play and emit an actuation signal in response thereto;

d. said mobile field communicator and timing communicator channel selectors synchronized to produce assignment of a unique address to said mobile field communicators and timing communicators devices and said channel selectors allowing independent operation without interference from other mobile field communicator and timing communicator devices in use in close proximity;

e. a programmable analog timer located in close proximity to the field of play but located outside the field play and said timer connected to said timing communicator;

f. said timer adapted to actuate transmission of a signal from said timing communicator to said mobile field communicator upon expiration of a programmed time period; and, g. said mobile field communicator upon receipt of said signal from said timing communicator actuating sensory alerts.

2. A system as described in claim 1, the improvement compromising transmission of warning signals prior to expiration of the programmed time period.

3. A system as described in claim 1, the improvement compromising said sensory alerts being of ascending intensity.

4. A system as described in claim 1, the improvement compromising a light emitting device connected to said sensory alerts to confirm receipt of the signal sent from the wireless transmitter to the on-field portable wireless receiver.

5. A system as described in claim 1, the improvement wherein said sensory alerts comprise vibrating sensory alerts.

6. A system as described in claim 1, 2, 3, 4 or 5, the improvement wherein said time keeping mechanism comprises a digital timekeeping system.

7. A system as described in claim 1, the improvement wherein said timekeeping mechanism is integrated with a scoreboard system.

8. A system as described in claim 7, the improvement wherein said timekeeping mechanism is digital.

9. A system as described in claim 2, the improvement wherein said timekeeping mechanism is integrated with a scoreboard system.

10. A system as described in claim 3, the improvement wherein said timekeeping mechanism is integrated with a scoreboard system.

11. A system as described in claim 4, the improvement wherein said timekeeping mechanism is integrated with a scoreboard system.

12. A system as described in claim 5, the improvement wherein said timekeeping mechanism is integrated with a scoreboard system.

13. A system as described in claim 12, the improvement wherein said timekeeping mechanism is digital.

14. A system for use in controlling and communicating the timing of a single athletic event between a timekeeping mechanism and a referee, the improvement compromising:

a. at least one timing communicator device;

b. said at least one timing communicator device having a switch means, a transmitter means, a receiver means and a channel selector, c. said transmitter means responsive to the switch means and channel selector and said transmitter means adapted to transmit a wireless electromagnetic radiation signal from outside the field of play to the field of play;

d. at least one mobile field communicator also having a transmitter means and a receiver means and a channel selector, said receiver and transmitter means responsive to said channel selector;

e. said at least one mobile field communicator adapted to be carried by the umpire or referee on the field of play and to receive said wireless signal from outside the field of play and emit an actuation signal in response thereto;

f. said mobile field communicator and timing communicator channel selectors synchronized to produce assignment of a unique address to said mobile field communicators and timing communicators;

g. said channel selector allowing independent operation of the timing and mobile communicators without interference from other mobile field communicator and timing communicator operated in simultaneously and in close proximity;

h. a programmable analog timer located in close proximity to the field of play but located outside the field play and said timer connected to said timing communicator;

i. said timer adapted to actuate transmission of a signal from said timing communicator to said mobile field communicator upon expiration of a programmed time period;

j. said mobile field communicator upon receipt of said signal from said timing communicator actuating sensory alerts;

k. said mobile field communicator also adapted to transmit a signal from said mobile field communicator to said timing communicator; and, l. said signal from said mobile field communicator adapted to actuate said time keeping mechanism.

15. A system as described in claim 14, the improvement compromising transmission of warning signals prior to expiration of the programmed time period.

16. A system as described in claim 14, the improvement compromising said sensory alerts being of ascending intensity.

17. A system as described in claim 14, the improvement compromising a light emitting device connected to said sensory alerts to confirm receipt of the signal sent from the wireless transmitter to the on-field portable wireless receiver.

18. A system as described in claim 14, the improvement wherein said sensory alerts comprise vibrating sensory alerts.

19. A system as described in claims 14, 15, 16, 17 or 18, the improvement compromising a digital timekeeping system.

20. A system as described in claims 14, 15, 16, 17, or 18, the improvement wherein said mobile field communicator comprises an audible sensory alert to inform the athletic event participants that play has started or stopped.

21. A system as described in claim 14, the improvement wherein said timekeeping mechanism is integrated with a scoreboard system.

22. A system as described in claim 21, the improvement wherein said timekeeping mechanism is digital.

23. A system as described in claim 15, the improvement wherein said timekeeping mechanism is integrated with a scoreboard system.

24. A system as described in claim 16, the improvement wherein said timekeeping mechanism is integrated with a scoreboard system.

25. A system as described in claim 17, the improvement wherein said timekeeping mechanism is integrated with a scoreboard system.

26. A system as described in claim 18, the improvement wherein said timekeeping mechanism is integrated with a scoreboard system.

27. A system as described in claim 26, the improvement wherein said timekeeping mechanism is digital.

28. A system as described in claim 21, the improvement wherein said timekeeping mechanism is digital.

29. A system as described in claim 28, the improvement wherein said mobile field communicator comprises a sensory alert to inform the athletic event participants that play has started or stopped.

30. A system as described in claim 29, the improvement wherein said sensory alert is audible to event participants.

* * * * *